US009262900B2

(12) United States Patent
Luo et al.

(10) Patent No.: US 9,262,900 B2
(45) Date of Patent: Feb. 16, 2016

(54) SECURITY TAG FOR APPLICATION TO FOOTWEAR

(71) Applicants: Danhui Luo, Lake Worth, FL (US); John C. Ford, Boca Raton, FL (US); Kaley Ford, Boca Raton, FL (US); Thang T. Nguyen, Boca Raton, FL (US); Charles T. Turgeon, Lighthouse Point, FL (US)

(72) Inventors: Danhui Luo, Lake Worth, FL (US); John C. Ford, Boca Raton, FL (US); Kaley Ford, Boca Raton, FL (US); Thang T. Nguyen, Boca Raton, FL (US); Charles T. Turgeon, Lighthouse Point, FL (US)

(73) Assignee: Tyco Fire & Security GmbH, Rheinfall (CH)

( * ) Notice: Subject to any disclaimer, the term of this patent is extended or adjusted under 35 U.S.C. 154(b) by 0 days.

(21) Appl. No.: 14/585,942

(22) Filed: Dec. 30, 2014

(65) Prior Publication Data

US 2015/0137978 A1 May 21, 2015

Related U.S. Application Data

(63) Continuation of application No. 14/031,083, filed on Sep. 19, 2013, now abandoned.

(60) Provisional application No. 61/703,329, filed on Sep. 20, 2012.

(51) Int. Cl.

| | |
|---|---|
| ***G08B 13/14*** | (2006.01) |
| ***G08B 13/24*** | (2006.01) |
| ***E05B 73/00*** | (2006.01) |
| ***E05B 17/00*** | (2006.01) |

(52) U.S. Cl.

CPC ..... *G08B 13/2434* (2013.01); *E05B 17/0029* (2013.01); *E05B 73/0017* (2013.01)

(58) Field of Classification Search

CPC ..... G08B 13/2434

See application file for complete search history.

(56) References Cited

U.S. PATENT DOCUMENTS

| | | | | |
|---|---|---|---|---|
| 5,022,244 | A | 6/1991 | Charlot, Jr. | |
| 7,918,112 | B2 | 4/2011 | Fawcett et al. | |
| 7,984,629 | B2 * | 7/2011 | Xiaobin | A45C 13/20 242/382 |
| 8,031,073 | B2 | 10/2011 | Hogan et al. | |
| 8,081,075 | B2 | 12/2011 | Irmscher et al. | |
| 8,087,269 | B2 | 1/2012 | Conti et al. | |
| 8,106,772 | B2 | 1/2012 | Irmscher et al. | |
| 8,122,744 | B2 | 2/2012 | Conti et al. | |
| 8,403,227 | B2 * | 3/2013 | Day | E05B 73/0017 340/572.9 |
| 8,917,180 | B2 * | 12/2014 | Sayegh | E05B 73/0029 340/572.9 |
| 2012/0304710 | A1 | 12/2012 | Sayegh et al. | |

* cited by examiner

*Primary Examiner* — Hai L Nguyen

(74) *Attorney, Agent, or Firm* — Robert J. Sacco; Carol E. Thorstad-Forsyth; Fox Rothschild LLP

(57) ABSTRACT

Systems (100) and methods (1300) for operating a security tag (132). The methods involve: slidingly coupling a first engagement member (212) of the security tag to a first sidewall (208) forming a first right angle with a base (220) of an article; and extending a securement member (218) of the security tag across an exterior surface of the base of the article. A second engagement member (210) of the security tag is slidingly coupled to a second sidewall (206) opposed from the first sidewall and forming a second right angle with the base of the article. A length of the securement member is then decreased so as to place the securement member in a tensioned position whereby the security tag is secured to the article. The securement member can be locked in the tensioned position using a mechanical locking mechanism (222) of the security tag.

20 Claims, 13 Drawing Sheets

SECURITY TAG FOR APPLICATION TO FOOTWEAR

CROSS REFERENCE TO RELATED APPLICATIONS

This application is a continuation of U.S. patent application Ser. No. 14/031,083 filed on Sep. 19, 2013, which is a non-provisional application claiming priority of U.S. Provisional Application No. 61/703,329 filed on Sep. 20, 2012, which is herein incorporated in its entirety.

STATEMENT OF THE TECHNICAL FIELD

The inventive arrangements relate to security tags used in Electronic Article Surveillance ("EAS") systems. More particularly, the inventive arrangements concern security tags and methods for preventing the unauthorized removal of articles (e.g., footwear) from a given location (e.g., a retail store).

DESCRIPTION OF THE RELATED ART

A typical EAS system in a retail setting may comprise a monitoring system and at least one security tag or label attached to an article to be protected from unauthorized removal. The monitoring system establishes a surveillance zone in which the presence of security tags and/or labels can be detected. The surveillance zone is usually established at an access point for the controlled area (e.g., adjacent to a retail store entrance and/or exit). If an article enters the surveillance zone with an active security tag and/or label, then an alarm may be triggered to indicate possible unauthorized removal thereof from the controlled area. In contrast, if an article is authorized for removal from the controlled area, then the security tag and/or label thereof can be deactivated and/or detached therefrom. Consequently, the article can be carried through the surveillance zone without being detected by the monitoring system and/or without triggering the alarm.

Security tags for EAS systems can be constructed in any number of configurations. The desired configuration of a security tag is often dictated by the nature of the article to be protected. For example, pre-packaged goods which are subject to retail theft (e.g., Compact Discs ("CDs") and small electronic devices) may each contain a security label disposed within its packaging in such a way that the security label is hidden from an onlooker's sight (at least during a pre-purchase period of time). In contrast, non-packaged goods (e.g., clothing, shoes, and purses) may each have a security tag coupled thereto. The security housing comprises a rigid housing in which a security label is disposed. The rigid housing typically includes a pin which is inserted through a portion of the non-packaged good (e.g., the fabric of a piece of clothing) and secured in place via locking mechanism. The security tag cannot be removed from the non-packaged good without destroying the rigid housing, except by using an EAS security tag deactivator/remover.

In the non-packaged good scenario, the article incurs some damage as a result from the pins insertion therethrough. High-end retailers and customers dislike having expensive merchandise (e.g., leather goods) damaged by retail theft deterrent devices. Shoes are especially difficult to protect using devices having pins, as the materials from which the shoes are constructed often suffer permanent damage from the pins.

Shoes present other difficulties for pinned security tags. For example, the materials from which certain shoes are made are often too rigid to insert the pins therein and/or too thick to insert the pins therethrough such that the pins can be locked by the locking mechanisms. Many retailers attempt to secure certain types of shoes using security tags in which the pins and/or lanyard thereof are inserted through lace eyelets or tongue areas of the shoes. This practice is fine for a few shoe types (e.g., sneakers), but the security tags interfere with the fitting and lacing process of the shoes.

Various solutions have been derived from overcoming the above identified problems associated with protecting the unauthorized removal of non-packaged goods from retail stores. One such solution involves using pinless security tags which pinch or clamp the articles between a housing and an arm thereof. An exemplary pinless security tag configured to secure footwear is disclosed in U.S. patent application Ser. No. 12/894,738. One can appreciate that such pinching and clamping applies a compressive force on the article, which may cause damage to the article. Also, if a pinching or clamping force is not provided for securing the pinless security tag to the article, then the security tag can be removed from the article by an unauthorized person. As such, the security tag may not actually prevent the unauthorized removal of the article from the retail store.

SUMMARY OF THE INVENTION

The present invention concerns systems and methods for operating a security tag of an EAS system. The methods involve slidingly coupling a first engagement member (e.g., a clip or hook) to a first sidewall (e.g., a rear right side quarter) forming a first right angle with a base (e.g., a sole) of an article (e.g., a low heeled shoe with an enclosed upper formed of a rigid or semi-rigid material). The first engagement member is attached to a housing of the security tag. Thereafter, a securement member (e.g., a cable) of the security tag is extended across an exterior surface of the base of the article. The securement member is formed of a slender length of flexible material having a first end coupled to the housing of the security tag. A second engagement member (e.g., a clip or hook) of the security tag is then slidingly coupled to a second sidewall (e.g., a rear left side quarter) opposed from the first sidewall and forming a second right angle with the base of the article. The second engagement member is attached to a second end of the securement member. Once the second engagement member is coupled to the article, a length of the securement member is decreased so as to place the securement member in a tensioned position whereby the security tag is secured to the article. Next, the securement member is locked in the tensioned position using a mechanical locking mechanism of the security tag. The mechanical locking mechanism may be configured to be unlocked by applying a magnetic field thereto.

When the security tag is securely coupled to the article, the EAS system can be used to detect when the article enters a surveillance zone. Also, the first and/or second engagement member can be prevented from being slidingly decoupled from the respective first or second sidewall of the article. The sliding decoupling is prevented by at least one anti-defeat structure of the security tag. The anti-defeat structure protrudes out and away from the first engagement member, the second engagement member, or the housing of the security tag in a direction towards an exposed surface of the article. In some scenarios, the anti-defeat structure engages the exposed surface of the article so as to cause the first or second sidewall of the article to become jammed at a location of the anti-defeat structure when an attempt to slidingly decouple the respective first or second engagement member from the article is made. The anti-defeat structure can also be used to prevent rotation of the security tag relative to the article.

In some scenarios, the first and second engagement members are respectively coupled to the first and second sidewalls of the article without exerting compression forces on the article. This configuration ensures that damage will not be caused to the article by the engagement members when the security tag is in use. Also, the first engagement member is placed at a location on the first sidewall where sliding movement of the first engagement member by a certain distance in two opposing horizontal directions is prevented by first and second protrusions of the article (e.g., a tongue and a heel of a shoe). Similarly, the second engagement member is placed at a location on the second sidewall where sliding movement of the second engagement member by a certain distance in two opposing horizontal directions is also prevented by the first and second protrusions of the article. This configuration ensures that the security tag cannot be decoupled from the article in an attempt to remove the article from a particular geographic location without proper authorization.

An exemplary architecture for the security tag will now be described. The security tag is generally configured to secure an article (e.g., a low heel shoe with an enclosed upper formed of a rigid or semi-rigid material). Accordingly, the security tag comprises a housing, a first engagement member, a second engagement member, a securement member, and a mechanical locking mechanism. The first engagement member (e.g., a clip or hook) is coupled to the housing and configured to slidingly engage a first sidewall (e.g., a rear right side quarter of a shoe) forming a first right angle with a base (e.g., a sole) of an article. Likewise, the second engagement member (e.g., a clip or hook) is configured to slidingly engage a second sidewall opposed from the first sidewall and forming a second right angle with the base of the article (e.g., a rear left side quarter of a shoe).

In some scenarios, the first and second engagement members comprise hooks for coupling the security tag to the first and second sidewalls of the article without exerting compression forces on the article. Also, at least one of the first engagement member, the second engagement member, and the housing has a surface contoured to follow a profile of a respective surface of the article. This configuration ensures that the article is not damaged by the housing and/or engagement members when the security tag is coupled thereto.

The securement member is formed of a slender length of flexible material having a first end coupled to the housing of the security tag and a second end coupled to the second engagement member. The securement member is transitionable between (1) a non-tensioned position in which a first length of the securement member is suitable for extension across an exterior surface of the base of the article and (2) a tensioned position in which a second length of the securement member is suitable for securing the security tag to the article. In some scenarios, the securement member passes through an eyelet coupled to a first end of each said first and second engagement members. The eyelets provide a means for: maintaining alignment of the securement with a horizontal axis of the article base when the security tag is in use; and/or ensuring that frictional damage is not caused to the article when the security tag is affixed thereto.

The mechanical locking mechanism is coupled to the housing and configured to lock the securement member in the tensioned position. The mechanical locking mechanism may be configured to be unlocked by the application of a magnetic field thereto. The mechanical locking mechanism may further be configured for transitioning the securement member between the non-tensioned position and the tensioned position. In this case, the mechanical locking mechanism comprises a wind-up type locking mechanism.

The security tag can further comprise at least one anti-defeat structure protruding out and away from the housing and/or respective first or second engagement member. This structure can be provided for preventing at least one of the first and second sidewalls of the article from being slidingly decoupled from the security tag when in use. In this regard, the anti-defeat structure is configured to engage an exposed surface of the article so as to cause the first or second sidewall of the article to become jammed at a location of the anti-defeat structure when an attempt to slidingly decouple the respective first or second engagement member from the article is made during use of the security tag. The anti-defeat structure can also be configured to prevent rotation of the security tag relative to the article. In some scenarios, the anti-defeat structure comprises: an eyelet coupled to the first engagement member or housing so as to be angled relative to a vertical axis thereof and having an aperture through which the securement member passes; an eyelet coupled to the second engagement member so as to be angled relative to a vertical axis thereof and having an aperture through which the securement member passes; and/or a protrusion that is located at or adjacent to a location where an upper portion of the article is coupled to a lower portion of the article.

Also, a security label can be disposed on or in the housing of the security tag. The security label is generally configured to cause an alarm to be activated when the article to which the security tag is affixed enters a surveillance zone of the EAS system.

In some scenarios, the first engagement member can be placed at a location on the first sidewall where sliding movement of the first engagement member by a certain distance in two opposing horizontal directions is prevented by first and second protrusions of the article (e.g., a tongue and a heel of a shoe). Similarly, the second engagement member can be placed at a location on the second sidewall where sliding movement of the second engagement member by a certain distance in two opposing horizontal directions is prevented by the first and second protrusions of the article. This configuration ensures that the security tag cannot be decoupled from the article in an attempt to remove the article from a particular geographic location without proper authorization.

BRIEF DESCRIPTION OF THE DRAWINGS

Embodiments will be described with reference to the following drawing figures, in which like numerals represent like items throughout the figures, and in which.

DETAILED DESCRIPTION

Figure 1:
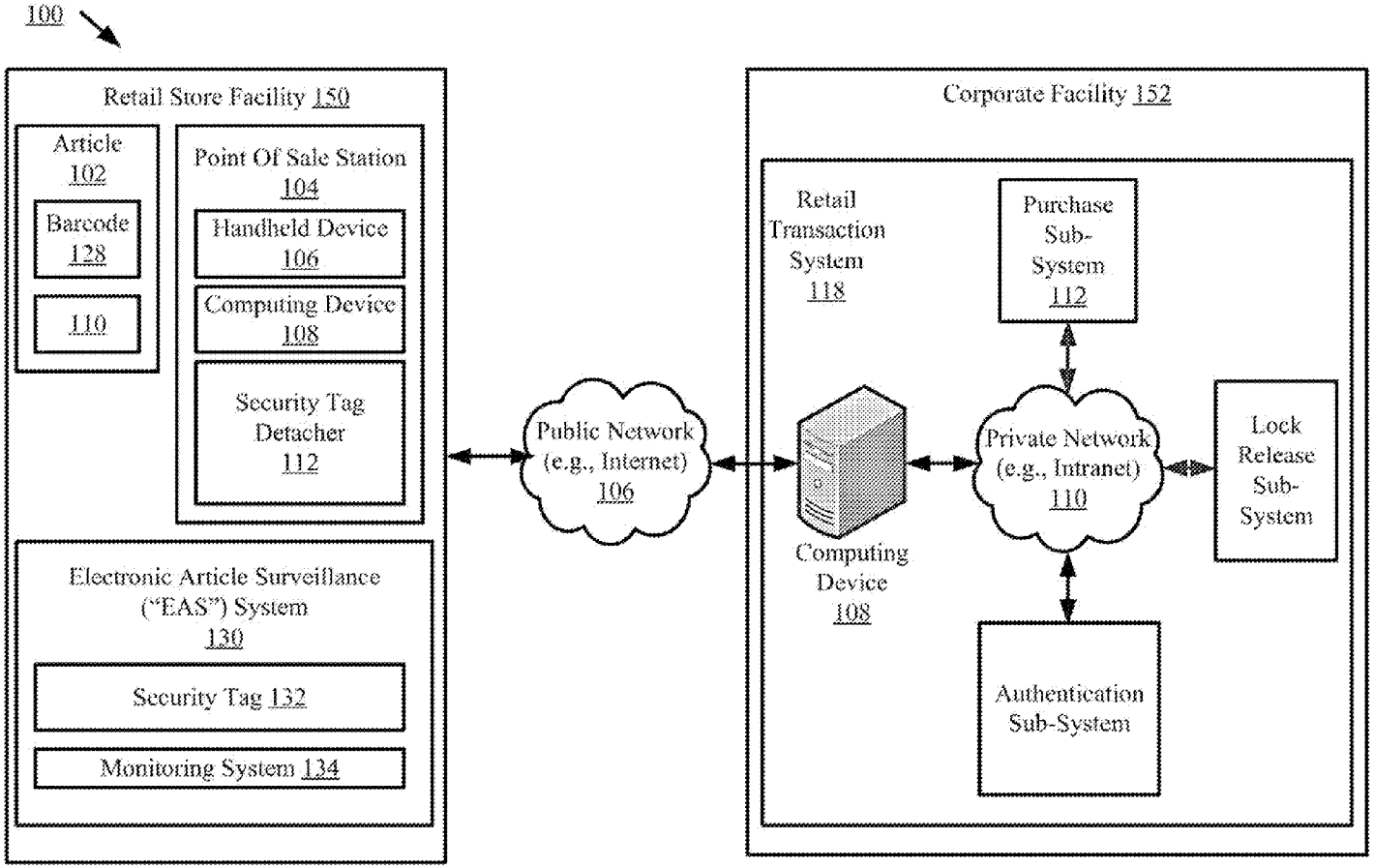
FIG. 1 is a schematic illustration of an exemplary system that is useful for understanding the present invention.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects as illustrative. The scope of the invention is, therefore, indicated by the appended claims. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout the specification may, but do not necessarily, refer to the same embodiment.

Furthermore, the described features, advantages and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment", "an embodiment", or similar language means that a particular feature, structure, or characteristic described in connection with the indicated embodiment is included in at least one embodiment of the present invention. Thus, the phrases "in one embodiment", "in an embodiment", and similar language throughout this specification may, but do not necessarily, all refer to the same embodiment.

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

Embodiments will now be described with respect to FIGS. 1-13. Embodiments generally relate to systems and methods for providing an innovative security tag for articles (e.g., footwear) which can be used in an EAS system. In the footwear scenarios, some shoes (e.g., men's dress shoes) provide a challenge for the attachment of security tags thereto because of their low profile, lack of prominent heels or other protruding features, and types of material from which they are formed. The security tags of the present invention overcome such challenges. In this regard, the security tags are each configured (1) to be attached to a shoe without loops or straps and (2) to have high defeat resistance for protection of shoes with an enclosed upper portion formed of a relatively rigid material (e.g., leather) and a heel with a relatively low height (e.g., a loafer type of shoe).

Each security tag is designed such that it secures the shoe without exerting any or a minimal amount of compression force thereon. In this regard, the security tag comprises two engagement members (e.g., clips or hooks) designed to (1) slidingly receive opposite rear side quarters of a shoe (i.e., the vertical portions of a shoe upper that define the sidewalls of an insert space for a foot) and (2) thereafter hang from the top portions of the sidewalls defining the shoe's rear side quarters. The engagement members are connected to opposing ends of a length adjustable securement member (e.g., a cable) coupled to a main body of the security tag. Therefore, once the engagement members are coupled to the opposing shoe rear side quarters, the securement member extends along an exposed surface of a shoe sole between the left and right sides of the shoe. Since the securement member has an adjustable length, it can then be tightened to snuggly couple the security tag and the shoe. After being tightened, the securement member is locked in its tightened or tensioned position.

Notably, the security tag advantageously comprises features to prevent the shoe rear side quarters or sidewalls from being pushed out of the engagement members (e.g., clips or hooks) in an attempt to defeat the security tag. These features will be described in detail below. Also, the security tag is not overly visible to the person trying on the shoe. In this regard, it should be appreciated that the security tag is attached to the sides of the shoe, and therefore does not obstruct the front view and only minimally obstructs the side views of the shoe.

Figure 2:
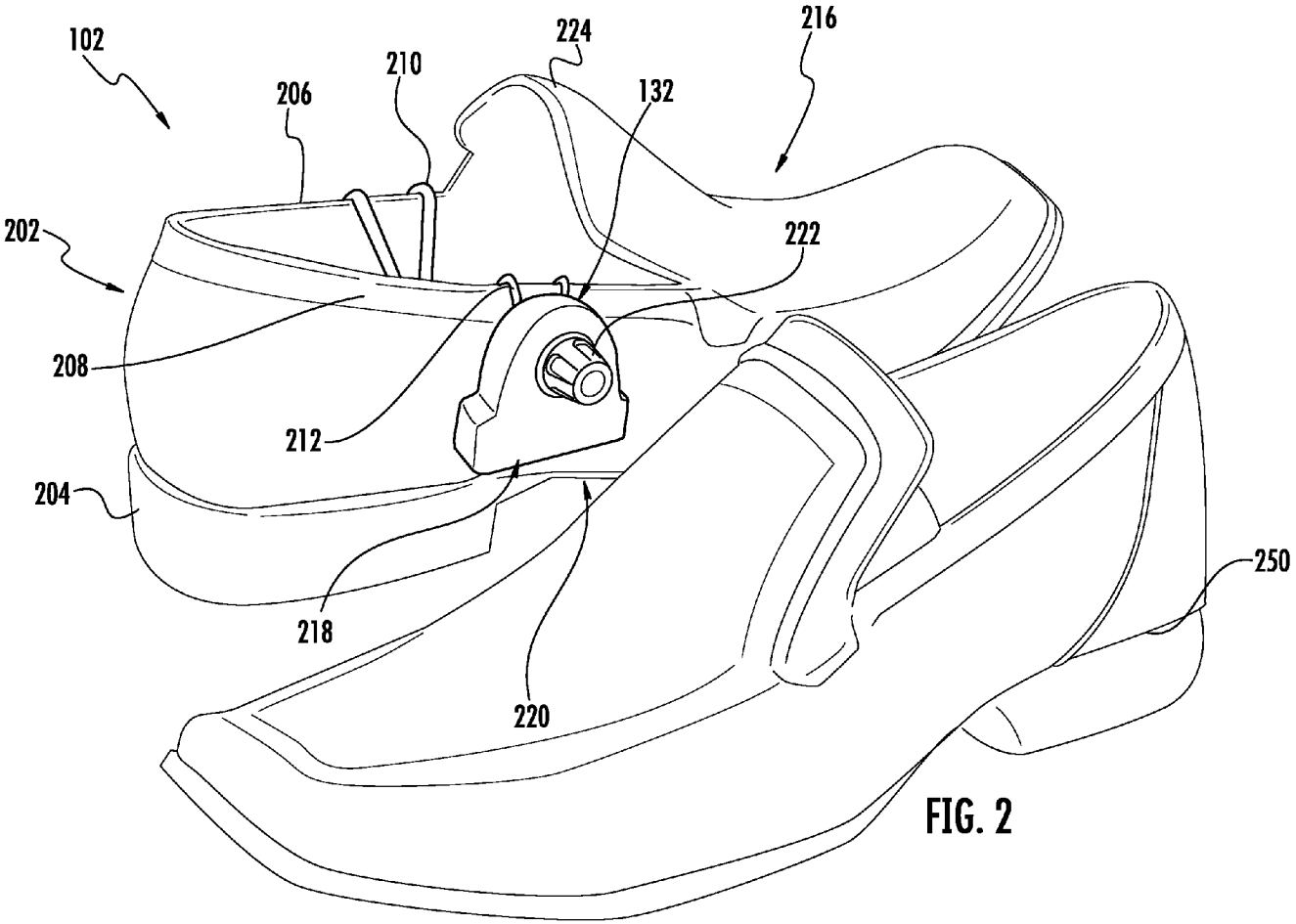
FIG. 2 is schematic illustration of an exemplary security tag secured to an article that is useful for understanding the present invention.

Referring now to FIG. 1, there is provided a schematic illustration of an exemplary system 100 that is useful for understanding the present invention. System 100 comprises a retail store facility 150 including an EAS 130. The EAS 130 comprises a monitoring system 134 and at least one security tag 132. Although not shown in FIG. 1, the security tag 132 is attached to article 102, thereby protecting the article 102 from an unauthorized removal from the retail store facility 150. A schematic illustration of the security tag 132 attached to an article 102 is provided in FIG. 2. As shown in FIG. 2, the article can include, but is not limited to, footwear. The monitoring system 134 establishes a surveillance zone (not shown) within which the presence of the security tag 132 can be detected. The surveillance zone is established at an access point (not shown) for the retail store facility 150. If the security tag 132 is carried into the surveillance zone, then an alarm is triggered to indicate a possible unauthorized removal of article 102 from the retail store facility 150.

During store hours, a customer (not shown) may desire to purchase the article 102. The customer can purchase the article 102 using a Point Of Sale ("POS") station 104. The POS station 104 can include, but is not limited to, a traditional fixed Point Of Sale ("POS") station (e.g., a checkout counter) or a mobile POS station. In either scenario, a retail transaction application executing on a computing device 108 of the POS station 104 facilitates the exchange of data between the article 102, security tag 132, customer, store associate (not shown), and/or Retail Transaction System ("RTS") 118 of a corporate facility 152. For example, after the retail transaction application is launched, a store associate is prompted to start a retail transaction process for purchasing the article 102. The retail transaction process can be started simply by performing a user software interaction, such as depressing a key on a keypad of the computing device 108 or touching a button on a touch screen display of the computing device 108.

Subsequently, the store associate may manually input into the retail transaction application article information. Alternatively or additionally, the store associate may place a handheld device 106 of the POS station 104 in proximity of article 102. As a result of this placement, the POS station 104 obtains article information from the article 102. The article information includes any information that is useful for purchasing the article 102, such as an article identifier and an article purchase price. In some scenarios, the article information may even include an identifier of the security tag 132 attached thereto. The article information can be communicated from the article 102 to the handheld device of the POS station 104 via a short range communication, such as a barcode communication or a Near Field Communication ("NFC").

In the barcode scenario, article 102 has a barcode 128 attached to an exposed surface thereof. The term "barcode", as used herein, refers to a pattern or symbol that contains embedded data. Barcodes may include, for example, one-dimensional barcodes, two dimensional barcodes (such as matrix codes, Quick Response ("QR") codes, Aztec codes and the like), or three-dimensional bar codes. The embedded data can include, but is not limited to, a unique identifier of the article 102 and/or a purchase price of article 102. The barcode 128 is read by a barcode scanner/reader (not shown in FIG. 1) of the POS station 104. Barcode scanners/readers are well known in the art. Any known or to be known barcode scanner/reader can be used herein without limitation.

In the NFC scenarios, article 102 may comprise an NFC enabled device 110. The NFC enabled device 110 can be separate from security tag 132 or comprise security tag 132. An NFC communication occurs between the NFC enabled device 110 and the handheld device 106 over a relatively small distance (e.g., N centimeters or N inches, where N is an integer such as twelve). The NFC communication may be established by touching components 102, 106 together or bringing them in close proximity such that an inductive coupling occurs between inductive circuits thereof. In some scenarios, the NFC operates at 13.56 MHz and at rates ranging from 106 kbit/s to 848 kbit/s. The NFC may be achieved using NFC transceivers configured to enable contactless communication at 13.56 MHz. NFC transceivers are well known in the art, and therefore will not be described in detail herein. Any known or to be known NFC transceivers can be used herein without limitation.

After the POS station 104 obtains the article information, payment information is input into the retail transaction application of POS station 104. The payment information can include, but is not limited to, a customer loyalty code, payment card information, and/or payment account information. The payment information can be input manually, via an electronic card reader (e.g., a magnetic strip card reader), or via a barcode reader. Electronic card readers and barcode readers are well known in the art, and therefore will not be described herein. Any known or to be known electronic card reader and/or barcode reader can be used herein without limitation. The payment information can alternatively or additionally be obtained from a remote data store based on a customer identifier or account identifier. In this case, the payment information can be retrieved from stored data associated with a previous sale of an article to the customer.

Upon obtaining the payment information, the POS station 104 automatically performs operations for establishing a retail transaction session with the RTS 118. The retail transaction session can involve: communicating the article information and payment information from the POS station 104 to the RTS 118 via a public network 106 (e.g., the Internet); completing a purchase transaction by the RTS 118; and communicating a response message from the RTS 118 to the POS station 104 indicating that the article 102 has been successfully or unsuccessfully purchased. The purchase transaction can involve using an authorized payment system, such as a bank Automatic Clearing House ("ACH") payment system, a credit/debit card authorization system, or a third party system (e.g., PayPal®, SolidTrust Pay® or Google Wallet®).

Notably, the communications between the POS station 104 and computing device 108 of the RTS 118 may be secure communications in which cryptography is employed. In such scenarios, a cryptographic key can also be communicated from the POS station 104 to RTS 118, or vice versa. The cryptographic key can be a single use cryptographic key. Any type of cryptography can be employed herein without limitation.

The purchase transaction can be completed by the RTS 118 using the article information and payment information. In this regard, such information may be received by a computing device 108 of the RTS 118 and forwarded thereby to a subsystem of a private network 100 (e.g., an Intranet). For example, the article information and purchase information can also be forwarded to and processed by a purchase subsystem 112 to complete a purchase transaction. When the purchase transaction is completed, a message is generated and sent to the POS station 104 indicating whether the article 102 has been successfully or unsuccessfully purchased.

If the article 102 has been successfully purchased, then a security tag detaching process can be started. During the security tag detaching process, a security tag detacher 112 of the POS station 104 is used to cause actuation of a detaching mechanism of the security tag 132. Once the security tag 132 has been detached from article 102, the customer 140 can carry the article 102 through the surveillance zone without setting off the alarm.

Referring now to FIG. 2, there is provided a schematic illustration of the security tag 132 attached to an article 102. As noted above, the article 102 can include, but is not limited to, a low heel shoe. As such, the security tag 132 will be described below in relation to a low heeled shoe. However, the present invention is not limited in this regard. The security tag can be used with other types of articles, which have (1) opposing sidewalls (e.g., rear side quarters 206, 208 of FIG. 2) on which two clips or hooks can be respectively attached, and (2) vertically offset top and bottom protrusions (e.g., shoe heel 204 and shoe tongue 224 of FIG. 2) preventing the sliding movement of the clips or hooks a certain distance in each of two opposing horizontal directions, which can result in the removal of the security tag from the article without unlocking the securement member. The securement member can be formed of a slender length of flexible material. As such, the securement member can include, but is not limited to, a strap, a cable, a rope, or a lanyard.

As shown in FIG. 2, the security tag 132 is generally designed to be removably coupled to the two opposing rear side quarters of a shoe 206, 208 (i.e., the vertical portions of a shoe upper 202 that define the sidewalls of an insert space for a foot), without exerting excessive pressure or compression force on the shoe. In this regard, the security tag 132 comprises two engagement members 210, 212 (e.g., clips or hooks) each designed to slidingly receive a respective rear side quarter 206, 208 of the shoe so as to couple the security tag 132 thereto. The engagement members 210, 212 will be described in more detail below. Still, it should be understood that the engagement members 210, 212 are each configured to have a first portion shaped to mate or match the exterior profile of the respective rear side quarter 206, 208, so as to minimize or eliminate any potential damage to the shoe by the security tag 132. Each engagement member 210, 212 is further configured to have a second portion shaped to mate or match the interior profile of the respective rear side quarter 206, 208 for allowing one to comfortably try on the shoe without distraction or annoyance from the security tag 132.

Figure 14:
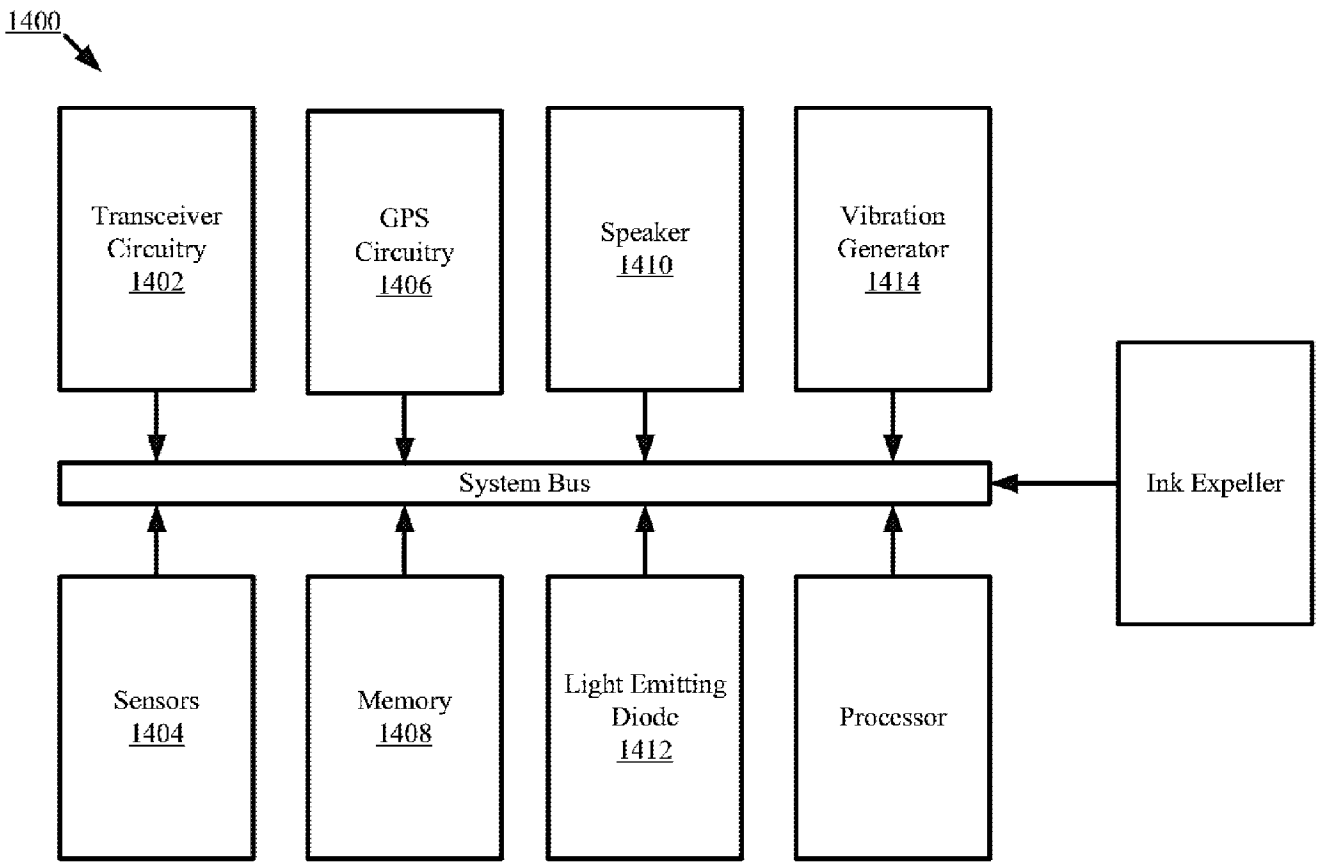
FIG. 14 is a block diagram of exemplary circuitry of a security tag which is useful for understanding the present invention.

In some scenarios, the security tag 132 is designed to expel ink when a sensor (e.g., sensor 1404 of FIG. 14) thereof detects an attempt to break an engagement member 210, 212, detects that the engagement member 210, 212 has been broken or bent, and/or detects that an attempt has been made to disengage/decouple the engagement member 210, 212 from the security tag. Various audio (e.g., an alarm), visual (e.g., light), and/or tactile indicators (e.g., vibration) can also be output from the security tag 132 when an unauthorized attempt is made to remove the security tag from the article, or from a particular geographical location. Sensor information, audio/visual/tactile indicator information, and/or geographic location information may be communicated from the security tag to a remote communication device (e.g., a mobile or stationary point of sale device 106, 108 of FIG. 1, or a mobile device of a store employee) so as to (1) immediately inform a store associate that an unauthorized attempt to remove the security tag from an article is occurring or has just occurred at a certain location in the facility and/or (2) continuously or periodically information the store associate as to the location of the security tag. As such, the security tag can include internal circuitry (e.g., circuitry 1400 of FIG. 14), such a GPS circuitry (e.g., GPS circuitry 1406 of FIG. 14), transceiver circuitry (e.g., transceiver circuitry 1402 of FIG. 14), and memory (e.g., memory 1408 of FIG. 14). Communication of this information may be triggered upon the detection of an attempt to cut or break the engagement member 210, 212 and/or an attempt has been made to disengage/decouple the engagement member 210, 212 from the security tag. Also, a disposable cloth sleeve can be provided for removable disposition on each engagement member 210, 212 so as to increase the cleanliness of the security tag when used to protect articles accessible by the general public.

As shown in FIG. 2, the security tag 132 also comprises a securement member 218 wrapped around a portion of the shoe sole 220. The securement member 218 can include, but is not limited to, an adjustable strap, an adjustable cable, an adjustable rope, or an adjustable lanyard. In some scenarios, the portion of the securement member which wraps around the shoe sole 220 comprises a soft fabric (e.g., felt) to ensure that damage will not be caused to the shoe as a result of frictional contact therebetween. This soft fabric may encompass or exclusively define the portion of the securement member 218.

In some scenarios, the security tag 132 is designed to expel ink when a sensor (e.g., sensor 1404 of FIG. 14) thereof detects an attempt to cut or break the securement member 218, detects that the securement member 218 has been cut or broken, and/or detects that an attempt has been made to disengage/decouple the securement member 218 from the security tag. Various audio (e.g., an alarm), visual (e.g., light), and/or tactile indicators (e.g., vibration) can also be output from the security tag 132 when an unauthorized attempt is made to cut, break or decouple the securement member 218. Accordingly, the security tag can include a speaker (e.g., speaker 1410 of FIG. 14), a light emitting diode (e.g., light emitting diode 1412 of FIG. 14), and/or a vibration generator (e.g., vibration generator 1414 of FIG. 14). Sensor information, audio/visual/tactile indicator information, and/or geographic location information may be communicated from the security tag to a remote communication device (e.g., a mobile or stationary point of sale device 106, 108 of FIG. 1, or a mobile device of a store employee) so as to (1) immediately inform a store associate that an unauthorized attempt to remove the security tag from an article is occurring or has just occurred at a certain location in the facility and/or (2) continuously or periodically information the store associate as to the location of the security tag. As such, the security tag can include internal circuitry, such a GPS circuitry (e.g., GPS circuitry 1406 of FIG. 14), transceiver circuitry (e.g., transceiver circuitry 1402 of FIG. 14), and memory (e.g., memory 1408 of FIG. 14). Communication of this information may be triggered upon the detection of an attempt to cut or break the securement member 218 and/or an attempt has been made to disengage/decouple the securement member 218 from the security tag.

The securement member 218 is locked in its wrapped position (shown in FIG. 2) via a locking mechanism 222. The locking mechanism 222 will be described in detail below. Still, it should be understood that the locking mechanism 222 can include, but is not limited to, a wind-up type locking mechanism, a clamp type locking mechanism, a latch type locking mechanism, a pin type locking mechanism, a pin gear type locking mechanism, a tack-retainer type locking mechanism, or other fastener based locking mechanism. The locking mechanism 222 can be unlocked via a mechanical means or a magnetic means. Notably, this securement architecture of the security tag 132 ensures that any potential damage to the shoe by security tag 132 is minimized or eliminated. In this regard, it should be emphasized that the securement member 218 need not be excessively tightened to secure the security tag 132 to the shoe with a suitably sized heel (e.g., <1 inch). As such, the securement member 218 is unlikely or less likely to cause frictional damage to the shoe.

As evident from FIG. 2, the security tag 132 is not overly visible. In this regard, it should be appreciated that the security tag 132 is attached to the sides of the shoe, and therefore does not obstruct the front view of the shoe. The security tag 132 also does not significantly interfere with the side views of the shoe. In some scenarios, the security tag 132 can be at least partially formed from a transparent material (such as a clear plastic) so as to further minimize any obstruction of the shoe's appearance by the security tag. Embodiments of the present invention are not limited in this regard. The security tag 132 can alternatively be formed of an opaque material, such as an opaque plastic.

Figure 3:
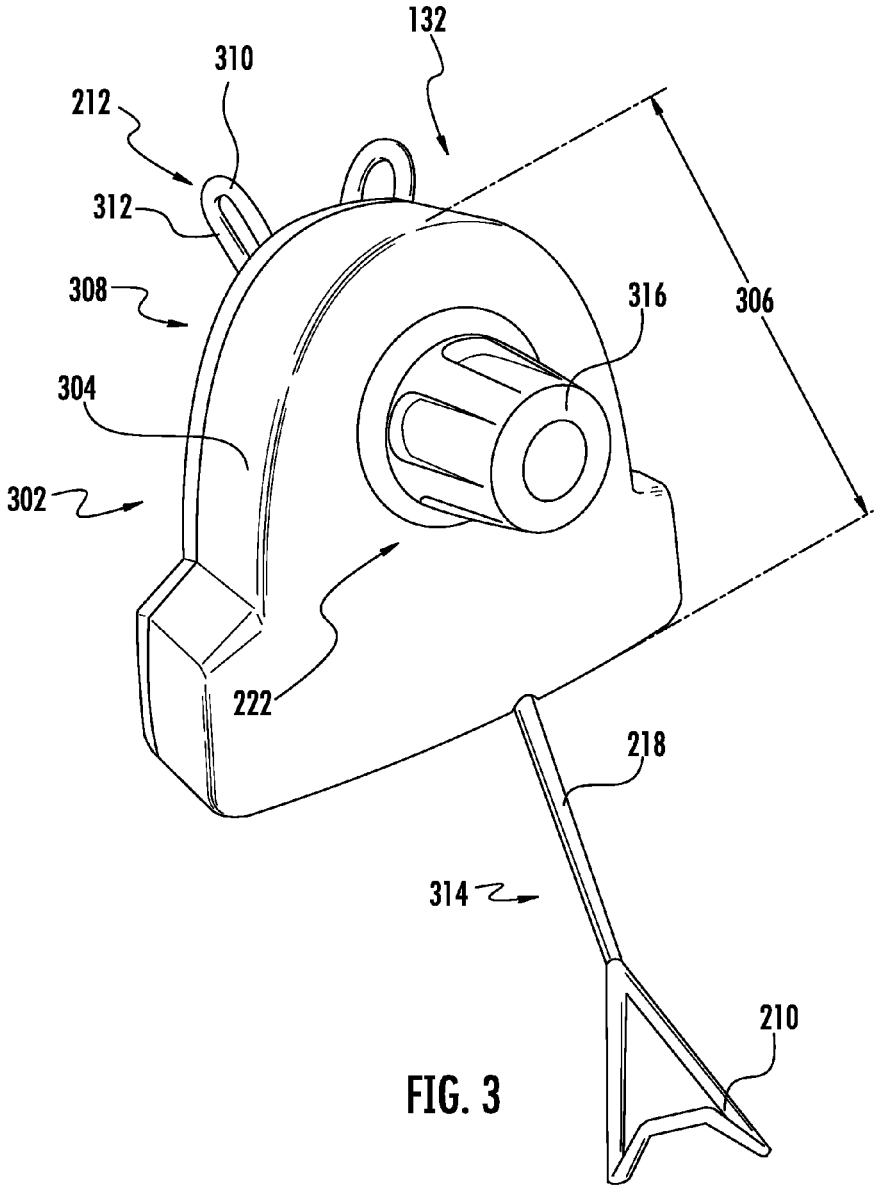
FIGS. 3-4 each provide a front perspective view of the security tag shown in FIG. 2 that is useful for understanding the present invention.
Figure 4:
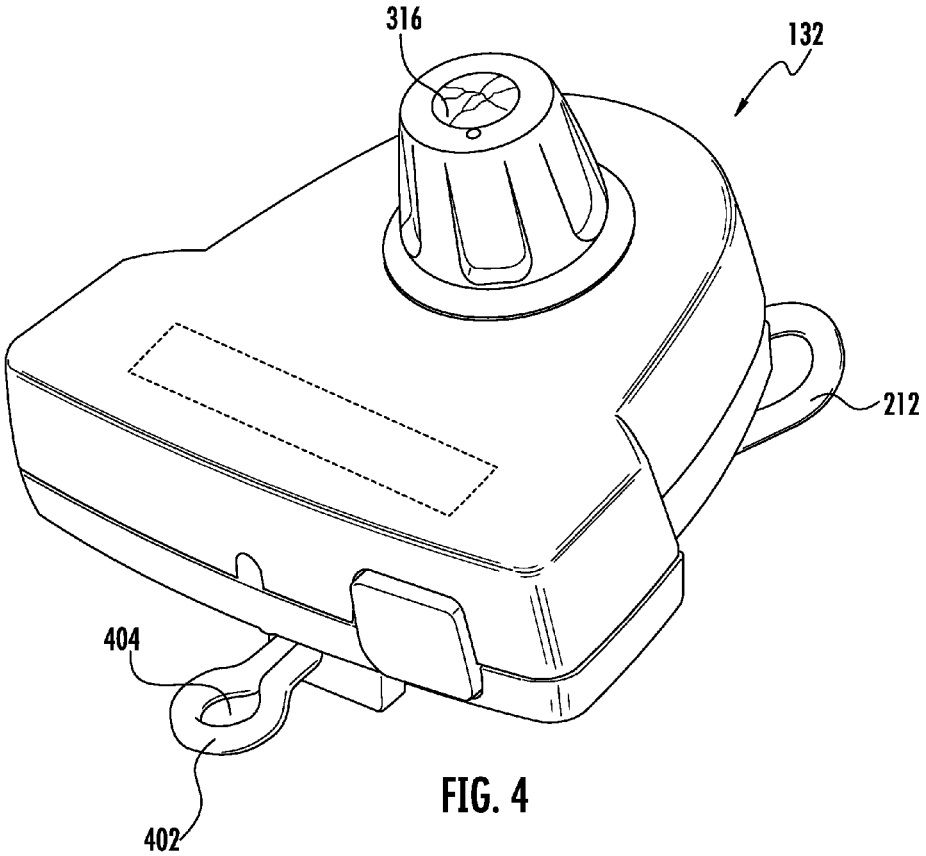

The security tag 132 will now be described in more detail in relation to FIGS. 3-6. The security tag 132 is shown in FIGS. 3-6 as being formed of an opaque material. As noted above, the invention is not limited in this regard. FIGS. 3-4 each provide a front perspective view of the security tag 132. A rear perspective view of the security tag 132 is provided in FIG. 5. A bottom view of the security tag 132 is provided in FIG. 6.

As shown in FIGS. 3-6, security tag 132 comprises a housing 302 in which at least a portion of the locking mechanism 222 is housed. The housing 302 can be formed from any suitable materials, such as plastic. The material from which the housing 302 is formed may be transparent or opaque. However, there are many advantages to using transparent materials for the housing 302. For example, transparent materials facilitate the minimization of any obstruction of the article's appearance by the security tag 132.

Housing 302 is generally configured to align closely with the contours of a side portion or rear side quarter 206, 208 of a shoe. As such, housing 302 comprises a body 304 formed of a rigid or semi-rigid material and configured to align vertically with a sidewall (not shown) of a shoe rear side quarter 206, 208. In this regard, the body 304 is sized and shaped to have a total height 306 approximately equal to the total height of the shoe rear side quarter 206, 208. At least a rear surface 502 of the body 304 is relatively smooth and contoured to follow the curve of the side portion or rear side quarter 206, 208 of the shoe. In this regard, the rear surface 502 has a generally smooth, slightly concave contour. As such, damage is not caused to the shoe when the rear surface 502 contacts the shoe rear side quarter 206, 208 during use of the security tag 132. In some scenarios, at least one member (e.g., a rubber member) is provided on the rear surface 502 to help prevent the rotation and/or linear movement of the housing 302 relative to the shoe.

In some scenarios, a security label (e.g., security label 708 of FIG. 7) is also disposed within the housing 302 or affixed to an exposed surface of the housing 302. Security labels are well known in the art, and therefore will not be described herein. Any known or to be known security label can be used herein without limitation. Still, it should be understood that the security label provides a way to detect when an article is being removed from a particular area by an unauthorized person(s) or in an unauthorized manner (e.g., without being purchased). As such, the security label includes a sensor operable with EAS technology. Such sensors can include, but are not limited to, an NFC sensor and/or an RFID sensor. In some scenarios, the security label is configured to provide an audible, visual and/or tactile alarm when it passes into the surveillance zone of an EAS system. An exemplary security label which can be used herein is the EAS Ultra•Max® narrow label sensor made by Sensormatic® Electronics Corporation. Also, the security label may comprise a passive device, an active device, and/or a hybrid passive/active device.

The engagement member 210 is attached or coupled to an end 314 of the securement member 218, which is retractable. The engagement member 210 comprises at least one curved portion 506 configured to couple at least two opposing elongate members 508, 510 together. In some scenarios, the curved portion 506 has a generally U-shape or C-shape. Also, the elongate members 508, 510 are affixed to or are integrally formed with the curved portion 506 of the engagement member 210 so as to extend along and be vertically aligned with each other. As such, the elongate members 508, 510 are in mutually tensioned arrangement with each other, whereby least a portion of an article can be held or gripped therebetween (e.g., as shown in FIG. 2). In some scenarios, the elongate members 508, 510 each (a) has a length which is less than the length of a shoe rear side quarter 206, 208 and (b) is contoured to follow the contour of the interior surface of a shoe's rear side quarter 206, 208. Accordingly, the interior of the shoe is not damaged by the elongate members 508, 510 when the security tag 132 is in use.

The engagement member 212 is attached to, coupled to or integrally formed with the housing 302 at or near a top portion 308 thereof. In this regard, the engagement member 212 comprises a curved portion 310 configured to couple an elongate member 312 to the housing 302. In some scenarios, the curved portion 310 has a generally U-shape or C-shape. Also, the elongate member 312 is affixed to or is integrally formed with a curved top portion 310 of the engagement member 212. The elongate member 312 extends along and is aligned with at least a portion of the rear surface 502 of the housing 302. As such, the elongate member 312 is in a mutually tensioned arrangement with the rear surface 502 such that at least a portion of an article can be held or gripped therebetween (e.g., as shown in FIG. 2). In some scenarios, the elongate member 312 (a) has a length 504 which is less than the length of a shoe rear side quarter 206, 208 and (b) is contoured to follow the contour of the interior surface of a shoe's rear side quarter 206, 208. Accordingly, the interior of the shoe is not damaged by the elongate member 312 when the security tag 132 is in use.

In some scenarios, the elongate members 510, 312 of the engagement members 210, 212 comprise one or more segments sized and shaped to provide a smooth implement that can be inserted into a shoe without interfering with a foot of a person wearing the shoe. The elongate members 510, 312 can be formed of any suitable rigid, semi-rigid or flexible material, such as plastic or metal. In some scenarios, a soft material is disposed on the elongate members 510, 312 for improving the comfort level of a person wearing the shoe. Additionally or alternatively, a disposable cloth sleeve can be provided for removable disposition on the elongate members 510, 312 so as to improve the comfort level of a person wearing the shoe, as well as increase the cleanliness of the security tag when used to protect articles accessible by the general public.

As shown in FIGS. 3-6, each engagement member 210, 212 has an eyelet 402, 520 formed at the bottom thereof. The eyelet 402, 520 has an aperture 404 sized and shaped to receive the securement member 218. The eyelets 402, 520 facilitate the positioning of the securement member 218 along an exposed surface of a shoe sole 220, when the security tag 132 is being coupled to a shoe 102. In this regard, the securement member 218 passes through the apertures of the eyelets 402, 520 and is slidable relative to the eyelets 402, 520. A stop 530 is provided to securely couple the securement member 218 to the engagement member 210. Embodiments of the present invention are not limited to the eyelet configuration shown in FIGS. 2-6. Alternatively, engagement member 212 may be absent of eyelet 520. In this case, an alignment mechanism (e.g., an eyelet or aperture) may be coupled to, disposed on, or integrally formed with body 304 of the security tag.

The security tag 132 also advantageously comprises features to prevent the shoe rear side quarters or sidewalls from being pushed out of the engagement members 210, 212 (e.g., a clip or a hook) in an attempt to defeat the security tag. The features are essential to the operation of the security tag. Without these features, the article could be decoupled relatively easily from the security tag without causing any alarm or indicators to be output in response to the defeat attempt activity. Notably, the features are designed to minimize or entirely prevent damage to the article 102 thereby. As such, the features generally comprise rigid or semi-rigid protruding structures. The protruding structures can comprise smooth surfaces, round edges, and a soft material disposed on at least a portion thereof. The features will also be referred to herein as "anti-defeat features".

Figure 5:
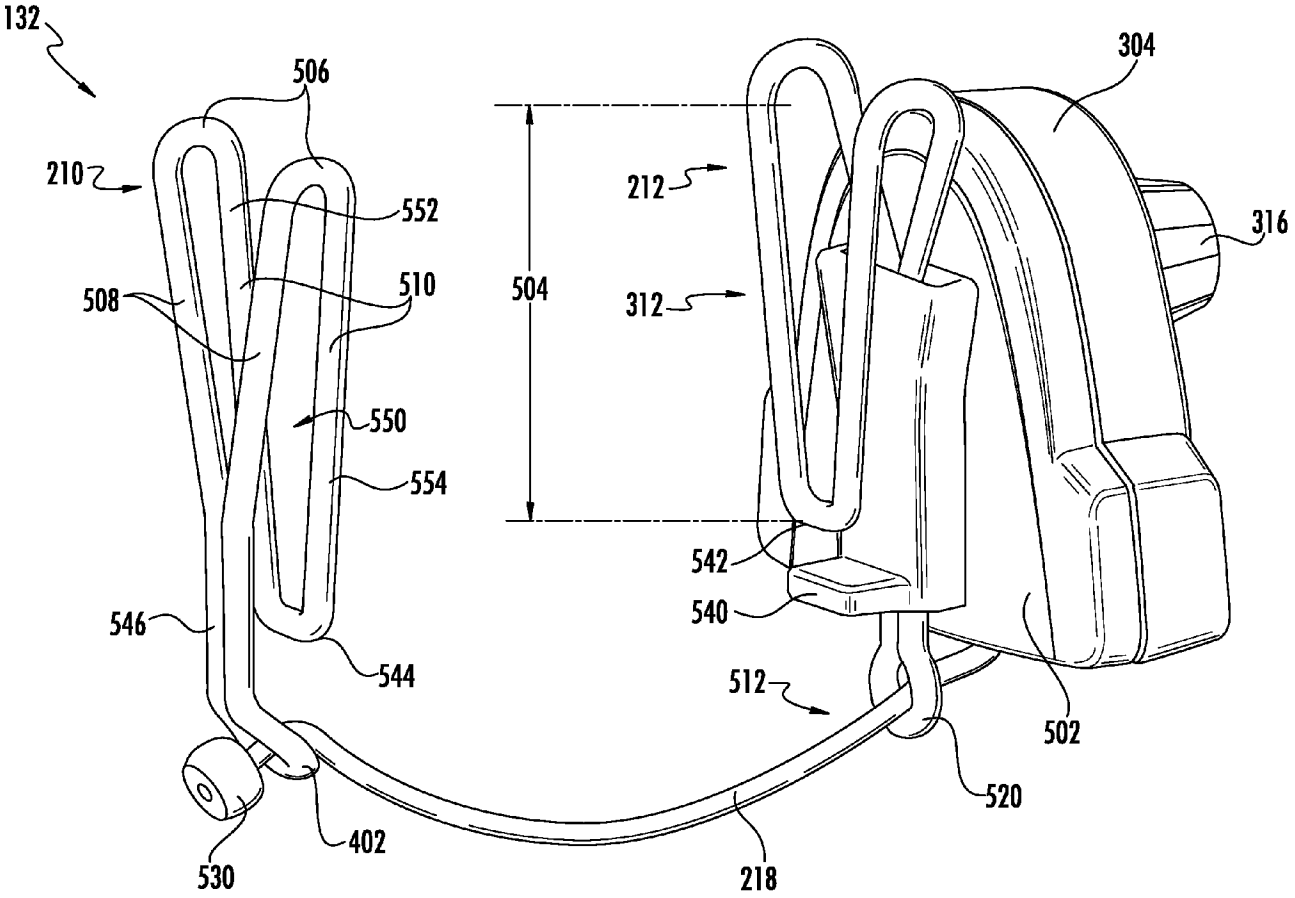
FIG. 5 is a rear perspective view of the security tag shown in FIG. 2 that is useful for understanding the present invention.
Figure 6:
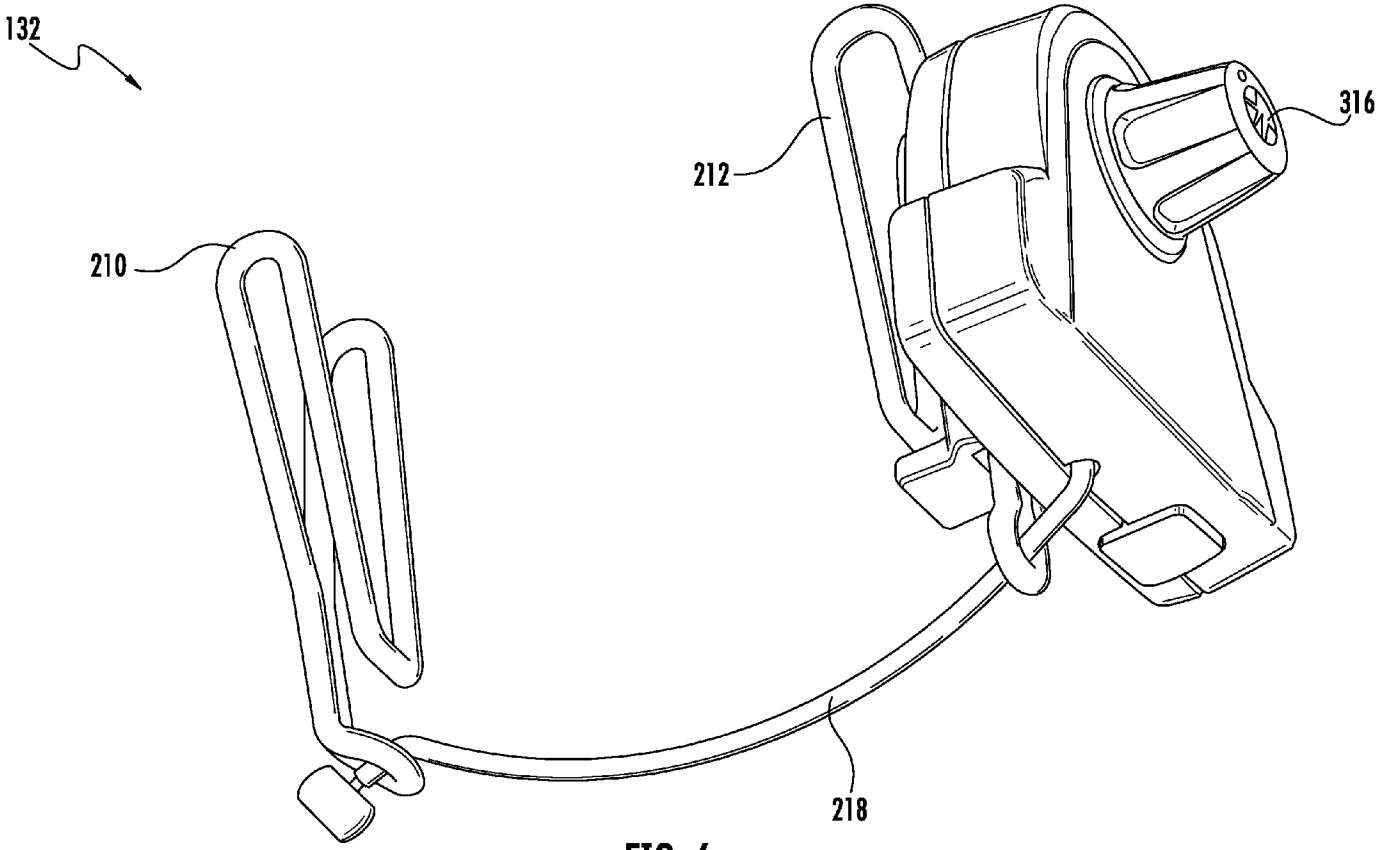
FIG. 6 is a bottom perspective view of the security tag shown in FIG. 2 that is useful for understanding the present invention.

In some scenarios, the anti-defeat features comprise at least one structure 402 which protrudes away from an engagement member 210. As shown in FIG. 5, structure 402 defines an eyelet which is angled relative to the elongate vertical side portion 508 of engagement member 210. In this regard, structure 402 can be configured to ensure that a distance between the shoe insole and a bottom surface 544 of the engagement member 210 is fixed or variable within a predefined range (e.g., 0 cm<Distance<1.5 cm), when the security tag 132 is secured to the shoe 102. In this case, if an unauthorized removal of the engagement member 210 (e.g., a clip or hook) is attempted by pushing and manipulating the shoe rear side quarter, then the rear side quarter material will become jammed between the engagement member 210 (e.g., a clip or hook) and the shoe insole. Notably, the eyelet anti-defeat feature 402 also prevents rotation of the security tag body 304 relative to the article, thereby further ensuring that the security tag cannot be decoupled from the article by an unauthorized person.

Embodiments of the present invention are not limited to this structure 402 design. Alternatively or additionally, at least one structure (not shown) can be provided which protrudes out and away from portion 508 and/or portion 546 towards portion 510 of the engagement member 210. In this case, the structure can be placed along portion 508 and/or portion 546 so that it engages an exterior sidewall of a respective shoe rear side quarter 206 when the security tag 132 is secured to the shoe 102. Accordingly, the quarter material will become jammed at the location of the structure when an attempt to defeat the security tag is performed. At least one protruding structure (not shown) can alternatively or additionally be provided on portion 546 so that it engages the shoe at location (e.g., location 250 of FIG. 2) in which the shoe upper is coupled (e.g., cemented or stitched) to the shoe sole. In this case, the quarter material will become jammed near the shoe insole when an attempt to defeat the security tag is performed. Also, rotation of the security tag body 304 relative to the article will be prevented, thereby further ensuring that the security tag cannot be decoupled from the article by an unauthorized person. In all of these scenarios, the anti-defeat features are designed so as not to cause the material of the shoe upper to be stretched or otherwise damaged thereby.

As shown in FIG. 5, the anti-defeat features can also comprise at least one structure 540 protruding out and away from body 304 towards engagement member 212. Structure 540 is placed at a location on surface 502 of body 304 so that it engages an exterior sidewall of a respective shoe rear side quarter 208 when the security tag 132 is secured to the shoe 102. This location is not limited to that shown in FIG. 5. During use, the rear side quarter material will become jammed at the location of the structure 540 when an attempt to defeat the security tag is performed. Embodiments of the present invention are not limited in this regard. For example, the anti-defeat features can additionally or alternatively include a structure (not shown) protruding out and away from engagement member 212. These anti-defeat structures of engagement member 212 can be the same as or different than those described above in relation to engagement member 210. For example, the anti-defeat structures can additionally or alternatively include a structure (not shown) coupled to a rear portion 508 of a respective engagement member 210, 212 so as to protrude towards an opening 550 in a front portion 510. If the front portion 510 is a solid structure (as opposed to the two wires 552, 554 shown in FIG. 5), then the front portion 510 can have an aperture formed therethrough at which the shoe quarter material can become jammed by the anti-defeat structure. In this scenario, the anti-defeat feature is designed so as not to cause the material of the shoe upper to be stretched or otherwise damaged thereby.

In each of the anti-defeat feature scenarios described above, the anti-defeat feature is configured to engage an exposed exterior surface of the article. Embodiments of the present invention are not limited in this regard. The anti-defeat features can alternatively or additionally be configured to engage an exposed interior surface of the article.

In some scenarios, at least one of the anti-defeat features comprise a sensor (e.g., sensor 1404 of FIG. 14) for sensing or detecting when an attempt to slidingly decouple the respective first or second engagement member from the article is made. The sensor can be electronically connected to circuitry (e.g., circuitry 1400 of FIG. 14) disposed in the housing of the security tag. The circuitry can be configured to output various audio (e.g., an alarm), visual (e.g., light), and/or tactile indicators (e.g., vibration) in response to such a detection by the sensor. Accordingly, the security tag can include a speaker (e.g., speaker 1410 of FIG. 14), a light emitting diode (e.g., light emitting diode 1412 of FIG. 14), and/or a vibration generator (e.g., a vibration generator 1414 of FIG. 14). Sensor information, audio/visual/tactile indicator information, and/or geographic location information may be communicated from the security tag to a remote communication device (e.g., a mobile or stationary point of sale device 106, 108 of FIG. 1, or a mobile device of a store employee) so as to (1) immediately inform a store associate that an unauthorized attempt to remove the security tag from an article is occurring or has just occurred at a certain location in the facility and/or (2) continuously or periodically information the store associate as to the location of the security tag. As such, the security tag can include internal circuitry, such a GPS circuitry (e.g., GPS circuitry 1406 of FIG. 14), transceiver circuitry (e.g., transceiver circuitry 1402 of FIG. 14), and memory (e.g., memory 1408 of FIG. 14).

As noted above, the securement member 218 can include, but is not limited to, a strap, a cable, a rope, or a lanyard having any length sufficient for allowing the engagement members 210, 212 to be coupled to an article (e.g., opposing rear side quarters 206, 208 of a shoe). In some scenarios, the securement member 218 has a first end 512 fixedly secured to the housing 302 and a second end 314 removable from the housing. In other scenarios, the first and/or second ends 314, 512 are capable of being removed from or retracted into the housing 302. Such first/second end configurations allow the securement member 218 to extend across an exposed surface of a shoe sole 220 and to be tightened so as to snuggly mate the security tag 132 to the shoe.

Once the securement member 218 is tightened, it can be locked in position by the locking mechanism 222. The locking mechanism 222 can include, but is not limited to, a wind-up type locking mechanism (as shown in FIGS. 2-6), a clamp type locking mechanism, a latch type locking mechanism, a cam type locking mechanism, a pin/tack type locking mechanism, and/or a pin gear type locking mechanism which is at least partially internal to the housing 302 and/or at least partially external to the housing 302. Examples of these various types of locking mechanisms which can be used with the present invention are described in U.S. Pat. Nos. 5,022,244, 7,918,112, 8,031,073, 8,081,075, 8,087,269, 8,106,772, and 8,122,744.

An exemplary architecture for a wind-up type locking mechanism will be described below in relation to FIGS. 7-9. Still, it should be understood that in at least some of the wind-up lock scenarios the securement member 218 (e.g., a cable) is threaded through a wind-up locking mechanism and disposed on a spool mechanism coupled to a rotating knob (e.g., actuator 316 of FIG. 3). One end of the securement member 218 is secured to the spool mechanism to provide a retractable rope with an adjustable length. The rotating knob allows manual adjustment of the length of the securement member 218, with the length of the securement member 218 being made smaller in one rotation direction of the knob and larger in the opposite rotation direction of the knob. The wind-up locking mechanism can include, but is not limited to, a wind-up locking mechanism disclosed in U.S. Pat. Nos. 7,918,112, 8,081,075, 8,087,269, 8,106,772, and/or 8,122,744. The entire disclosures of the listed patents are incorporated herein by reference. An exemplary architecture for a wind-up type locking mechanism will be described in detail below in relation to FIGS. 7-9.

An exemplary architecture for a latch type locking mechanism will be described below in relation to FIG. 10. Still, it should be understood that in at least some of the clamp and latch scenarios at least one loose end of the securement member 218 is retained between a pair of plates (which may or may not be disposed within the housing 302) or between a plate and a sidewall of the housing 302. The plates may have a smooth engagement surface or a rough engagement surface. The rough engagement surface can have teeth or protrusions formed thereon so as to provide a means for preventing a sliding removal of the securement member 218 from the clamp or latch. In this regard, the teeth/protrusions increase a frictional engagement or provide a mating engagement between the clamp and the securement member 218. Alternatively or additionally, the securement member 218 is retained between: a plate and a flat-head post. In this case, the plate, post and/or securement member 218 may have a series of teeth or protrusions formed on at least one end thereof so as to provide a means for preventing a sliding removal of the securement member 218 from the clamp or latch.

In the pin/tack and pin gear scenarios, the securement member 218 has one or more apertures formed through at least one end portion thereof for receiving the pin. When a pin is inserted into at least one aperture formed in the securement member 218, the securement member 218 is retained in position. An actuator may be provided for longitudinally and/or laterally moving a pin/tack or rotating a pin gear such that at least one pin/tack can be removably inserted into the aperture formed in the securement member 218. The actuator may comprise, but is not limited to, a rotatable knob, a pull-out knob, and/or a magnetic actuator. If the actuator is a magnetic actuator, then the pin/tack of the locking mechanism may be engaged with and/or disengaged from the securement member 218 via application of a magnetic field thereto.

Exemplary architectures for the various types of locking mechanism which can be used with the present invention will now be described in more detail. Schematic illustrations of a wind-up type locking mechanism 700 are provided in FIGS. 7-9. A schematic illustration of an exemplary latch type locking mechanism 1000 is provided in FIG. 10. Schematic illustrations of an exemplary magnetic cam type locking mechanism 1100 are provided FIGS. 11-12. Each of these different types of locking mechanisms will be discussed separately below.

Figure 7:
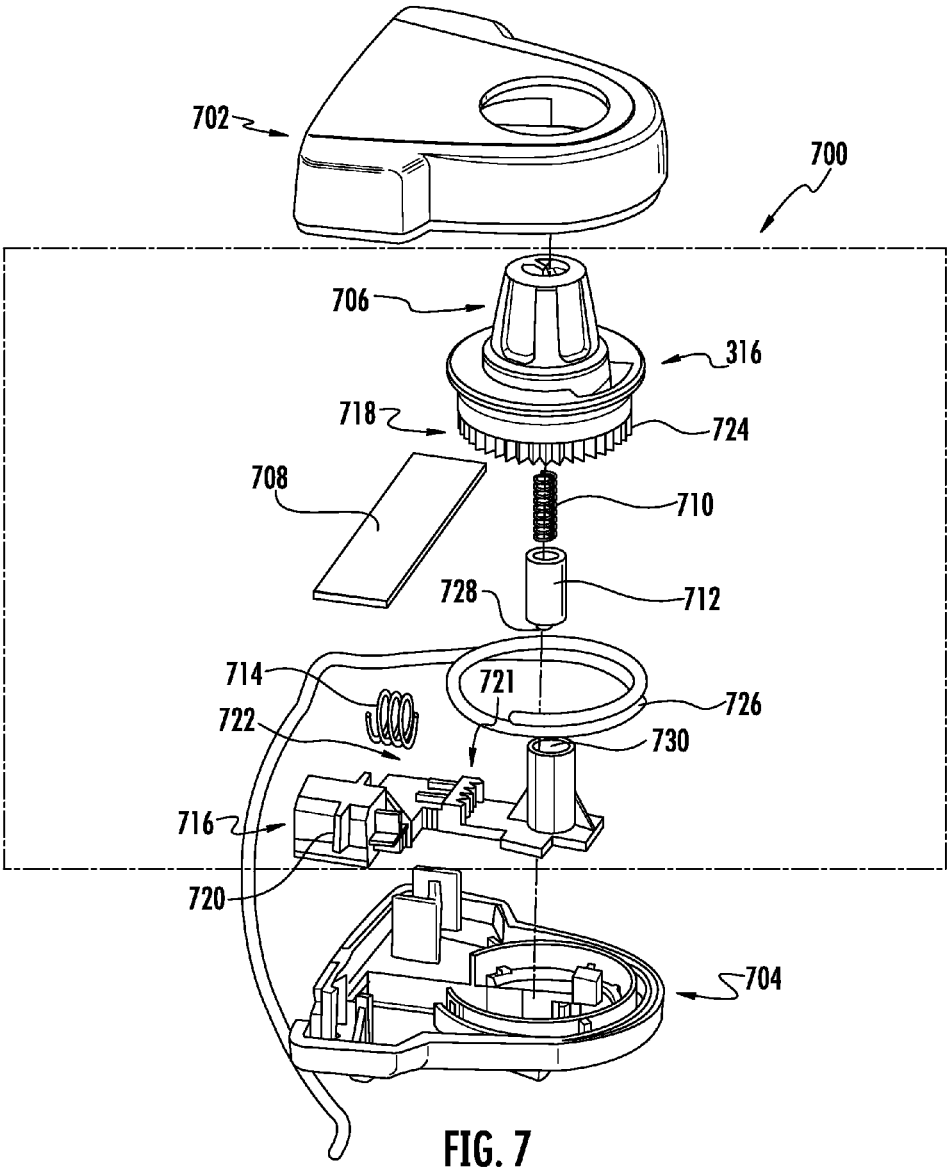
FIG. 7 is an assembly view of a portion of the security tag shown in FIG. 2 that is useful for understanding the present invention.
Figure 8:
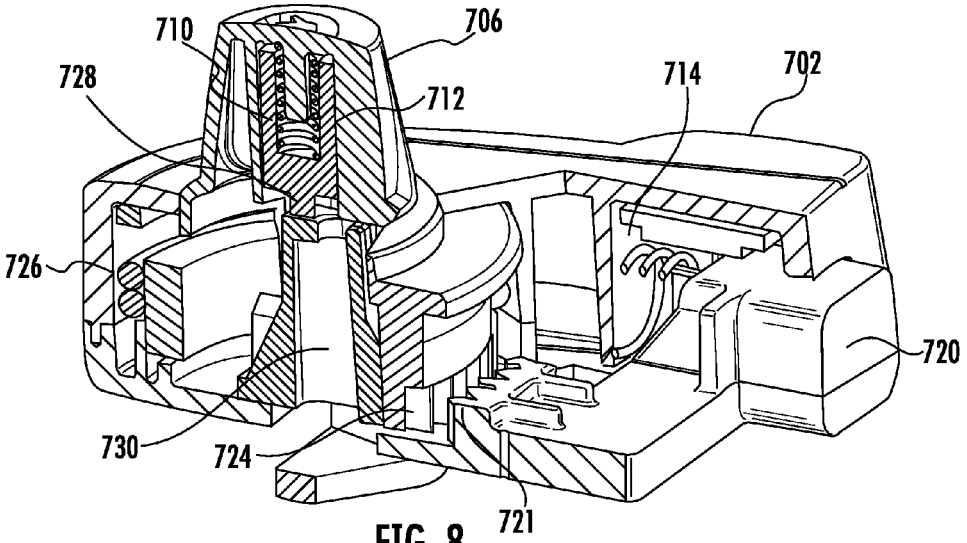
FIGS. 8-9 each provide a cut-away view of the wind-up type locking mechanism of FIG. 8 which is useful for understanding the operation thereof.
Figure 9:
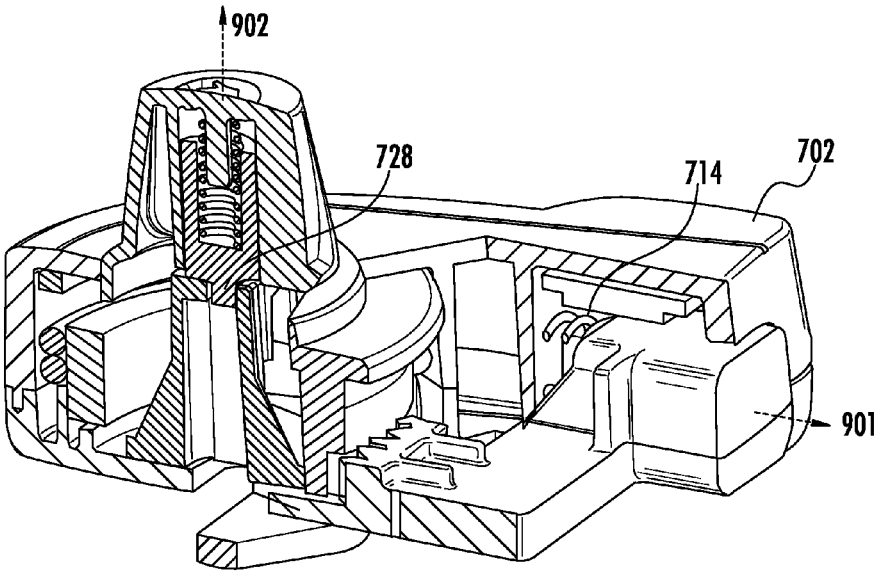

Referring now to FIGS. 7-9, the exemplary wind-up locking mechanism 700 is generally configured to allow the retention of a securement member (e.g., securement member 218 of FIGS. 2-6) within a security tag (e.g., security tag 132 of FIGS. 2-6) and the release of the security member from the security tag. Notably, the locking mechanism 214 is shown in FIGS. 2-6 to comprise a wind-up locking mechanism. The present invention is not limited in this regard. The locking mechanism 214 can be selected to include another type (e.g., such as those discussed below in relation to FIGS. 10-12) which is suitable for a particular application.

As shown in FIGS. 7-9, various components 706-716 of the locking mechanism 700 are at least partially disposed between a first cover 702 and a second cover 704, which can be coupled together to form a housing of the security tag (e.g., housing 302 of FIG. 3). The covers 702, 704 can be coupled together via a mechanical means and/or a chemical means. For example, the covers 702, 704 are ultrasonically welded together when the locking mechanism 700 is fully assembled.

In some scenarios, the security tag 132 is designed to expel ink when a sensor (e.g., sensor 1404 of FIG. 14) thereof detects an attempt to decouple the first cover 702 and the second cover 704 from each other, and/or otherwise damage the housing of the security tag. Various audio (e.g., an alarm), visual (e.g., light), and/or tactile indicators (e.g., vibration) can also be output from the security tag 132 when an unauthorized attempt is made to damage the housing of the security tag. Accordingly, the security tag can include a speaker (e.g., speaker 1410 of FIG. 14), a light emitting diode (e.g., light emitting diode 1412 of FIG. 14), and/or a vibration generator (e.g., vibration generator 1414 of FIG. 14). Sensor information, audio/visual/tactile indicator information, and/or geographic location information may be communicated from the security tag to a remote communication device (e.g., a mobile or stationary point of sale device 106, 108 of FIG. 1, or a mobile device of a store employee) so as to (1) immediately inform a store associate that an unauthorized attempt to damage the housing of the security tag is occurring or has just occurred at a certain location in the facility and/or (2) continuously or periodically information the store associate as to the location of the security tag. As such, the security tag can include internal circuitry, such a GPS circuitry (e.g., GPS circuitry 1406 of FIG. 14), transceiver circuitry (e.g., transceiver circuitry 1402 of FIG. 14), and memory (e.g., memory 1408 of FIG. 14). Communication of this information may be triggered upon the detection of an attempt to damage the security tag housing.

Referring again to FIGS. 7-9, the various components of the locking mechanism 700 include a knob 706, resilient members 710, 714, a magnetic plunger 712, and a button assembly 716. In some scenarios, the locking mechanism 700 further comprises an EAS label 708. In other scenarios, locking mechanism 700 is absent of the EAS label 708. EAS labels are well known in the art, and therefore will not be described herein. Still, it should be understood that the EAS label is generally configured to set off an alarm when it is activated and enters into an EAS surveillance zone.

The knob 706 is provided for allowing a user to rotate a gear wheel 718. The gear wheel 718 can be integrally formed with the knob 706 or attached to the knob 706 via a mechanical attachment means or a chemical attachment means. Rotation of the gear wheel 718 allows manual adjustment of the length of the securement member 726 (e.g., a cable) threaded through the locking mechanism 700. In this regard, it should be understood that both ends of the securement member 726 are secured within the locking mechanism 700 to provide a closed loop having an adjustable diameter. The knob 706 allows manual adjustment of the size of the closed loop, with the size of the loop being made smaller in one rotation direction and larger in the opposite rotation direction.

The button assembly 716 provides a means to retain the closed loop with a desired diameter. In this regard, the button assembly 716 includes a button 720 which is partially disposed within the housing 702, 704 and partially disposed outside the housing 702, 704. Button 720 is depressible by a user of the locking mechanism 700 so as to transition the button 720 between an unengaged position shown in FIG. 8 and an engaged position shown in FIG. 9. When the button assembly 716 is in its unengaged position, the knob 706 is rotatable. In contrast, knob 706 cannot be rotated when the button assembly 716 is in its engaged position. In this regard, it should be understood that teeth 721 are provided on a portion 722 of the button 720. The teeth 721 are configured to engage corresponding teeth 724 of the gear wheel 718 when the button 720 is depressed so as to be placed it in its engaged position. As a result of the engagement between teeth 721 and 724, the knob 706 is prevented from being rotated by a user of the locking mechanism 700.

Notably, when the button 720 is first placed in its engaged position, a post 728 of magnetic plunger 712 drops into a retention slot 730 of the button assembly 716, which prevents the teeth of the button assembly 716 and gear wheel 718 from disengaging until the magnetic plunger 712 is displaced in a direction shown by arrow 902. The magnetic plunger 712 may be displaced using an external magnetic detacher (not shown) so as to overcome a force exerted by resilient member 710 on magnetic plunger 712. Resilient member 710 can include, but is not limited to, a spring.

Resilient member 714 is provided to facilitate the release of the button assembly 716 such that the teeth 721 of the button assembly 716 are disengaged from teeth 724 of the gear wheel 718, thereby allowing the knob 706 to be rotated. The button assembly 716 is released when the magnetic field is applied to the magnetic plunger 712, whereby resilient member 714 pushes the button 720 out and away from the housing 702, 704, i.e., in a direction shown by arrow 904.

Figure 10:
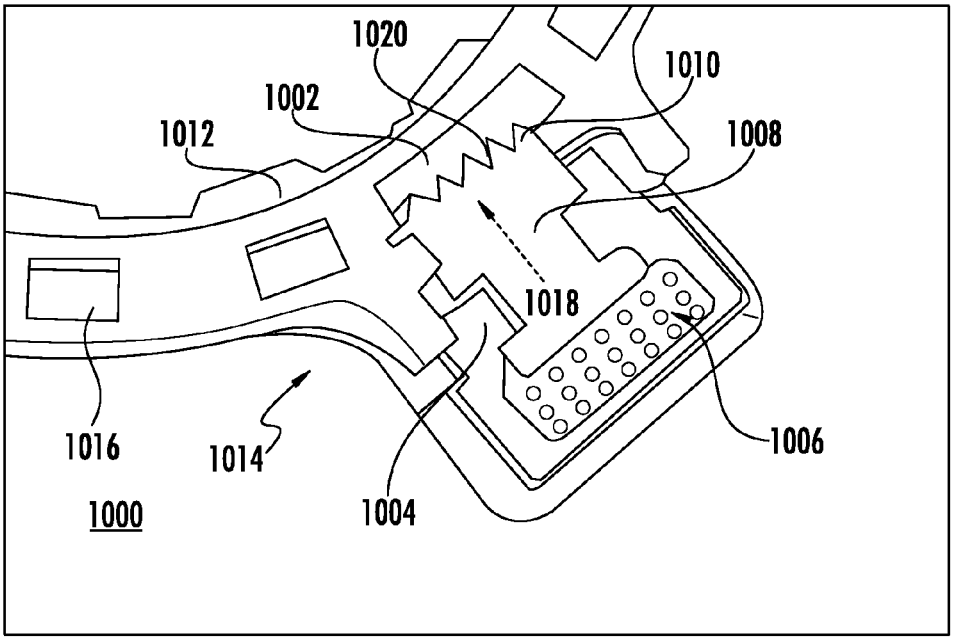
FIG. 10 is a schematic illustration of an exemplary latch type locking mechanism.

Referring now to FIG. 10, the exemplary latch type locking mechanism 1000 comprises a magnetically-actuable latch 1004. In this regard, latch 1004 is at least partially formed of a magnetic material. The magnetic material can include, but is not limited to, iron, nickel, cobalt, an alloy of iron, an alloy of nickel, and/or an alloy of cobalt.

The latch 1004 is configured to engage a securement member 1002 (e.g., a strap) so as to lock the securement member 1002 in position. This locking is at least partially achieved by moving the latch 1004 towards the securement member 1002 which is disposed in a channel 1016 formed in the housing 1014 of a security tag (e.g., security tag 132 of FIGS. 1-6). Stated differently, a body 1008 of the latch 1004 is moved in a direction of arrow 1018 until it engages the securement member 1002 and clamps the securement member 1002 between itself and a sidewall 1012 of the housing 1014. Notably, an engagement surface 1010 of latch 1004 and an engagement surface 1020 of the securement member 1002 have mating teeth or protrusions formed thereon. The teeth or protrusions can be angled against an insertion direction of the securement member 1002. These angled teeth or protrusions facilitate the securement of the securement member 1002 within the security tag in such a way that the securement member 1002 cannot be removed from the housing 1014 without unlocking the latch 1004, thereby thwarting attempts at forced extraction of the securement member 1002 from the locking mechanism 1000. Notably, the present invention is not limited to the mating teeth/protrusion configuration of the engagement surfaces 1010, 1020. Additionally or alternatively, the engagement surfaces 1010, 1020 can have ribs and/or mating holes and protrusions.

The latch body 1008 is biased into its locking position via a flexible element 1006. The flexible element 1006 may have any shape suitable for a particular application. For example, the flexible element 1006 can have a generally cuboid, ellipsoid, or coil shape. In some scenarios, the flexible element 1006 is a cantilever arm (e.g., a leaf spring). The flexible element 1006 can be formed from a flexible material. The flexible material can include, but is not limited to, a light, porous, semi-rigid, elastic, gaseous, and/or spongy material that may provide a resistant force when compressed and may partially or fully recover its uncompressed shape when the compressive force is removed.

The latch 1004 is unlocked using a detacher device (not shown in FIG. 10), such as that disclosed in U.S. Pat. No. 8,031,073 (the entire disclosure of which is incorporated herein by reference). In some scenarios, the detacher device includes at least one magnet for creating a magnetic field having sufficient strength to move the latch body 1008 in a direction opposed to the direction shown by arrow 1018. In this regard, the magnet is selected to provide a sufficient magnetic force to overcome the biasing force of the flexible element 1006. When the latch body 1008 is moved in this way, the latch 1004 is unlocked such that the securement member can be at least partially withdrawn from the housing 1014.

An exemplary magnetic cam type locking mechanism 1100 will now be discussed in relation to FIGS. 11-12. The locking mechanism 1100 is configured to secure the securement member 1102 (e.g., a cable) in its locked position shown in FIG. 11. In the regard, the locking mechanism 1100 comprises a housing 1104 in which various components thereof are disposed. The housing 1104 may be integrally formed with a housing of a security tag (e.g., security tag 132 of FIGS. 1-6) or attached to the security tag housing via a mechanical and/or chemical attachment means (e.g., a screw, a weld, and/or glue).

The locking mechanism 1100 comprises an eccentric cam wheel 1106 rotatably mounted on a pivot member 1108. In the locked position, the securement member 1102 is compressed between a flange 1150 of the cam wheel 1106 and a retaining member 1110. The flange 1150 is shown in FIGS. 11-12 as extending only partially around the can wheel 1106. Embodiments of the present invention are not limited in this regard. The cam wheel 1106 has ridges (or protrusions) 1112 formed on an engagement surface 1114 thereof. The ridges 1112 contact the securement member 1102 when in the locked position so as to securely grip the securement member 1102, thereby providing a means to thwart attempts at forced extraction of the securement member 1102 from the locking mechanism 1100. The ridges 1112 also guide the cable inwardly (i.e., in the opposite direction shown by arrow 1160) into the locking mechanism 1100 during insertion into the security tag (e.g., security tag 132 of FIGS. 1-6). In alternative scenarios, the cam wheel 1106 is absent of the ridges. As such, the contact between the securement member 1102 and the cam wheel 1106 is a frictional contact which is sufficient for the causing the cam wheel to rotate when the securement member is pulled in the direction shown by arrow 1160.

The locking mechanism 1100 also comprises a latch assembly 1116 for locking the securement member and cam wheel in their fully engaged position. The latch assembly 1116 includes a magnetic element 1118 contained in a housing 1120. The housing 1120 is movable in two opposing directions shown by arrows 1122 and 1202, such that the latch assembly 1116 can be transitioned between a locked position (shown in FIG. 11) and an unlocked position (shown in FIG. 12). The latch assembly 1116 is transitioned between its locked and unlocked positions via a resilient member 1124. Resilient member 1124 can include, but is not limited to, a spring formed of any material with an elasticity selected in accordance with a particular application. The latch assembly 1116 is transitioned from its locked position to its unlocked position when a magnetic field is applied thereto. When a magnetic field is applied to the locking mechanism 1100, the magnetic element 1118 overcomes the bias force of the resilient member 1124 to move the latch assembly 1116 in the direction shown by arrow 1202. Accordingly, the resilient member 1124 is in a compressed state when the latch assembly 1116 is biased in the locked position, and an uncompressed state when the latch assembly 1116 is in the unlocked position.

A locking element 1128 is attached to the cam wheel 1106 so as to extend radially outward therefrom. The locking element 1128 resides between two detents 1130, 1132 extending outwardly from housing 1120. The detents 1130, 1132 can be integrally formed with the housing 1120 or attached to the housing via a mechanical or chemical coupling means (e.g., a weld or glue). During a locking process (i.e., when a magnetic field is not being applied to the locking mechanism 1100), the detents 1130, 1132 contact the locking element 1128 and apply a force thereto so as to rotate the cam wheel 1106 in a direction shown by arrow 1134.

Detent 1132 has an angled engagement surface 1136 for engaging the locking element 1128. The engagement surface 1136 is angled to be approximately parallel to a surface 1138 of the locking element 1128 when the cam wheel 1106 is in its locked position, as shown in FIG. 11. The angled engagement surface 1136 serves to maintain the cam wheel 1106 in a locked position in which the ridges 1112 compress the securement member 1102 between the cam wheel 1106 and the retaining member 1110. A gap 1140 exists between surfaces 1136, 1138 when the locking mechanism 1100 in the locked position. The gap 1140 enables the locking element 1128 to rotate a certain distance before it contacts surface 1136 of the detent 1132.

When the securement member 1102 (e.g., a cable) is urged further into the locking mechanism 1100, the cam wheel 1106 rotates slightly until the locking element 1128 contacts detent 1132. This action causes the ridges 1112 to pull the securement member 1102 inwardly. If the securement member 1102 is pulled outwardly, the ridges 1112 act on the securement member 1102 so as to rotate the cam wheel 1106 in the opposite direction. In this scenario, the rotation of the locking element 1128 is arrested by contact with the securement member 1102, and the securement member 1102 is once again compressed between the cam wheel 1106 and the retaining member 1110. This arrangement advantageously allows further insertion of the securement member 1102 (e.g., a cable) to tighten slack in the securement member 1102 (e.g., a cable), while the device is locked and while preventing extraction of the securement member 1102.

Figure 11:
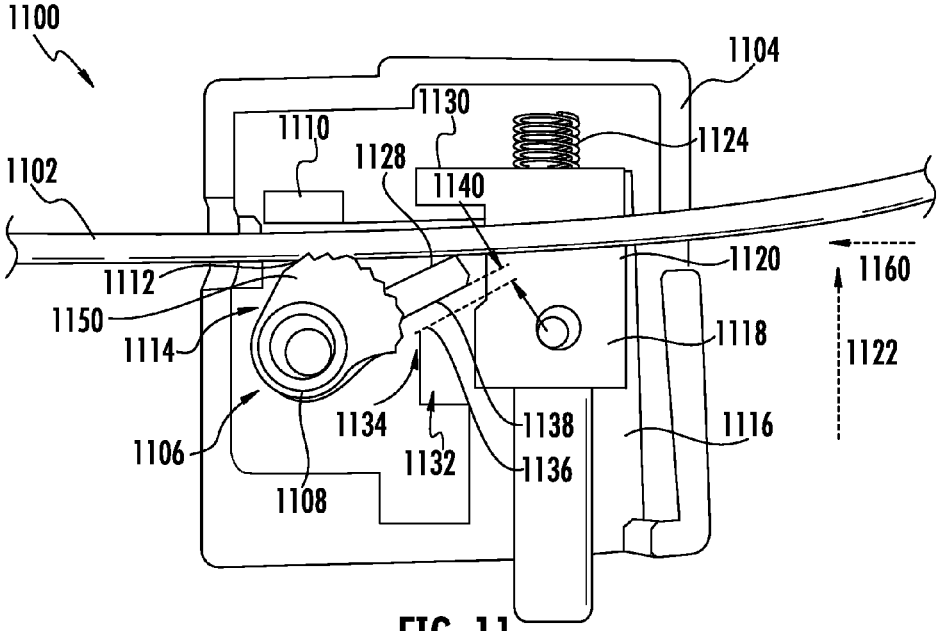
FIGS. 11-12 each provide a schematic illustration of an exemplary magnetic cam locking mechanism.
Figure 12:
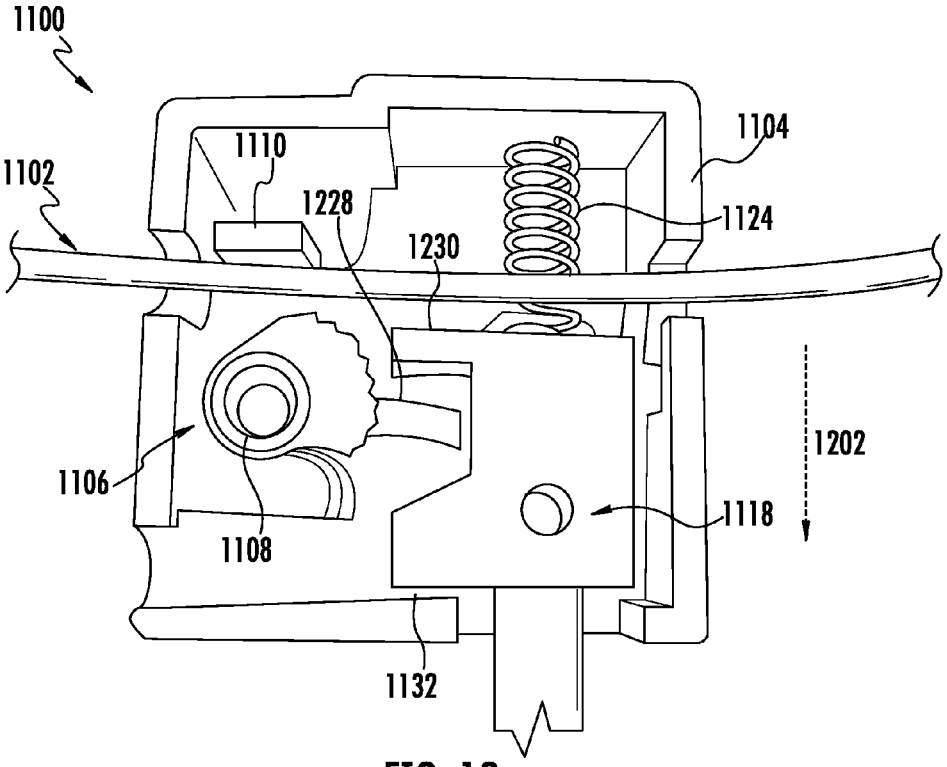

The locking mechanism 1100 is unlocked using a detacher device (not shown in FIGS. 11-12). The detacher device comprises a magnet for moving the latch assembly 1116 in the direction shown by arrow 1202 until detent 1130 rotates cam wheel 1106 to a position which permits extraction of the securement member 1102. A schematic illustration of the locking mechanism 1100 in its unlocked position is provided in FIG. 12.

The present invention is not limited to the architecture of locking mechanism 1100 shown in FIGS. 11-12. The locking mechanism 1100 can have any suitable design selected in accordance with a particular application. Accordingly, the locking mechanism 1100 can alternatively comprise a magnetically-actuable ball clutch locking arrangement.

Figure 13:
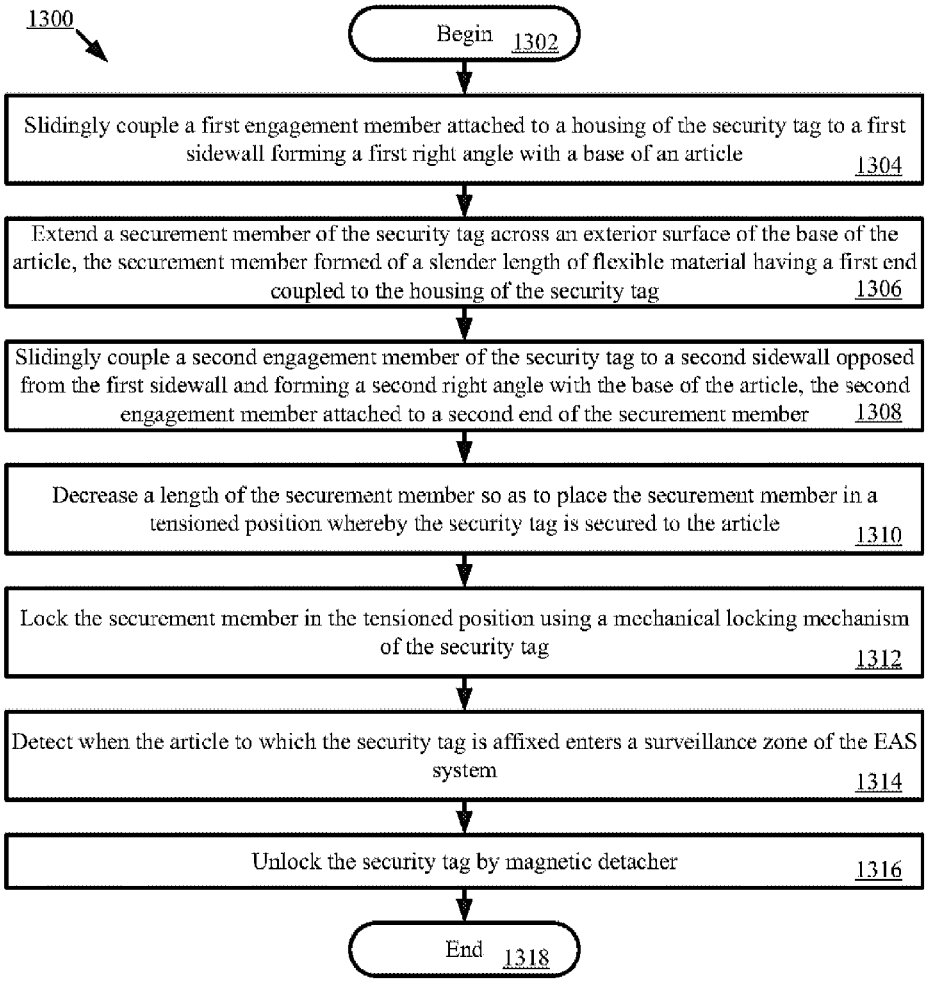
FIG. 13 is a flow diagram of an exemplary method for operating a security tag of an EAS system.

Referring now to FIG. 13, there is provided a flow diagram of an exemplary method 1300 for operating a security tag of an EAS system. Method 1300 begins with step 1302 and continues with step 1304. Step 1304 involves slidingly coupling a first engagement member attached to a housing of the security tag to a first sidewall forming a first right angle with a base of an article. Subsequently in step 1306, a securement member of the security tag is extended across an exterior surface of the base of the article. The securement member is formed of a slender length of flexible material having a first end coupled to the housing of the security tag. Thereafter in step 1308, a second engagement member of the security tag is slidingly coupled to a second sidewall opposed from the first sidewall and forming a second right angle with the base of the article. The second engagement member is attached to a second end of the securement member. The length of the securement member is then decreased so as to place the securement member in a tensioned position whereby the security tag is secured to the article, as shown by step 1310. The securement member is locked in the tensioned position using a mechanical locking mechanism of the security tag, as shown by step 1312. Once the security tag is secured to the article, the security tag can facilitate the detection of the article within a surveillance zone of the EAS system, as shown by step 1314. At some later time, step 1316 is performed where the mechanical locking mechanism is unlocked by applying a magnetic field thereto. In next step 1318, method 1300 ends.

All of the apparatus, methods and algorithms disclosed and claimed herein can be made and executed without undue experimentation in light of the present disclosure. While the invention has been described in terms of preferred embodiments, it will be apparent to those of skill in the art that variations may be applied to the apparatus, methods and sequence of steps of the method without departing from the concept, spirit and scope of the invention. More specifically, it will be apparent that certain components may be added to, combined with, or substituted for the components described herein while the same or similar results would be achieved. All such similar substitutes and modifications apparent to those skilled in the art are deemed to be within the spirit, scope and concept of the invention as defined.

We claim:

1. A method for operating a security tag of an Electronic Article Surveillance ("EAS") system, comprising:

slidingly coupling a first engagement member attached to a housing of the security tag to a first sidewall forming a first right angle with a base of an article;

extending a securement member of the security tag across an exterior surface of the base of the article, the securement member formed of a slender length of flexible material having a first end coupled to the housing of the security tag;

slidingly coupling a second engagement member of the security tag to a second sidewall opposed from the first sidewall and forming a second right angle with the base of the article, the second engagement member attached to a second end of the securement member;

decreasing a length of the securement member so as to place the securement member in a tensioned position whereby the security tag is secured to the article;

locking the securement member in the tensioned position using a mechanical locking mechanism of the security tag; and subsequent to said locking, preventing at least one of the first and second engagement members from being slidingly decoupled from the respective first or second sidewall of the article using at least one anti-defeat structure protruding out and away from the first engagement member, the second engagement member or the housing of the security tag in a direction towards an exposed outer surface of the article, where the anti-defeat structure does not cause damage to the exposed outer surface of the article when in use.

2. The method according to claim 1, wherein the article comprises a low heel shoe with an enclosed upper formed of a rigid or semi-rigid material, the first and second sidewalls define rear side quarters of the shoe, and the base defines a sole of the shoe.

3. The method according to claim 1, wherein the first and second engagement members are respectively coupled to the first and second sidewalls of the article without exerting compression forces on the article.

4. The method according to claim 1, further comprising placing the first engagement member at a location on the first sidewall where sliding movement of the first engagement member by a certain distance in two opposing horizontal directions is prevented by first and second protrusions of the article.

5. The method according to claim 1, further comprising placing the second engagement member at a location on the second sidewall where sliding movement of the second engagement member by a certain distance in two opposing horizontal directions is prevented by first and second protrusions of the article.

6. The method according to claim 1, wherein the anti-defeat structure engages the exposed surface of the article so as to cause the first or second sidewall of the article to become jammed at a location of the anti-defeat structure when an attempt to slidingly decouple the respective first or second engagement member from the article is made.

7. The method according to claim 1, further comprising using the anti-defeat structure to prevent rotation of the security tag relative to the article.

8. The method according to claim 1, further comprising unlocking the mechanical locking mechanism by applying a magnetic field thereto.

9. The method according to claim 1, further comprising detecting when the article to which the security tag is affixed enters a surveillance zone of the EAS system.

10. A security tag for use in an Electronic Article Surveillance ("EAS") system, comprising: a housing;

a first engagement member attached to the housing and configured to slidingly engage a first sidewall forming a first right angle with a base of an article;

a second engagement member configured to slidingly engage a second sidewall opposed from the first sidewall and forming a second right angle with the base of the article;

at least one anti-defeat structure protruding out and away from the housing, the first engagement member, or the second engagement member in a direction towards an exposed outer surface of the article, the anti-defeat structure configured to prevent at least one of the first and second engagement members from being slidingly disengaged from the respective first or second sidewall of the article when the security tag is in use and without causing damage to the exposed outer surface of the article when the security tag is in use;

a securement member formed of a slender length of flexible material having a first end coupled to the housing of the security tag, a second end coupled to the second engagement member, and transitionable between a non-tensioned position in which a first length of the securement member is suitable for extension across an exterior surface of the base of the article and a tensioned position in which a second length of the securement member is suitable for securing the security tag to the article; and a mechanical locking mechanism coupled to the housing and configured to lock the securement member in the tensioned position.

11. The security tag of claim 10, wherein the article comprises a low heel shoe with an enclosed upper formed of a rigid or semi-rigid material, the first and second sidewalls define rear side quarters of the shoe, and the base defines a sole of the shoe.

12. The security tag according to claim 10, wherein the first and second engagement members comprise hooks for coupling the security tag to the first and second sidewalls of the article without exerting compression forces on the article.

13. The security tag according to claim 10, wherein at least one of the first engagement member, the second engagement member, and the housing has a surface contoured to follow a profile of a respective surface of the article.

14. The security tag according to claim 10, wherein sliding movement of the first engagement member by a certain distance in two opposing horizontal directions is prevented by first and second protrusions of the article when the first engagement member is coupled to the first sidewall of the article.

15. The security tag according to claim 10, wherein sliding movement of the second engagement member by a certain distance in two opposing horizontal directions is prevented by first and second protrusions of the article when the second engagement member is coupled to the first sidewall of the article.

16. The security tag of claim 10, wherein the anti-defeat structure is further configured to engage an exposed surface of the article so as to cause the first or second sidewall of the article to become jammed at a location of the anti-defeat structure when an attempt to slidingly decouple the respective first or second engagement member from the article is made during use of the security tag.

17. The security tag of claim 10, wherein the anti-defeat structure is further configured to prevent rotation of the security tag relative to the article.

18. The security tag according to claim 17, wherein the anti-defeat structure comprises an eyelet coupled to the first engagement member or housing so as to be angled relative to a vertical axis thereof and having an aperture through which the securement member passes.

19. The security tag of claim 17, wherein the anti-defeat structure comprises an eyelet coupled to the second engagement member so as to be angled relative to a vertical axis thereof and having an aperture through which the securement member passes.

20. The security tag of claim 17, wherein the anti-defeat structure is located at or adjacent to a location where an upper portion of the article is coupled to a lower portion of the article.

* * * * *